United States Patent [19]

Hall et al.

[11] Patent Number: 4,632,049

[45] Date of Patent: Dec. 30, 1986

[54] MARINE PROPULSION STEERING ASSIST DEVICE

[75] Inventors: Charles B. Hall, Ingleside; Martin J. Mondek, Wonder Lake, both of Ill.

[73] Assignee: Outboard Marine Corporation, Waukegan, Ill.

[21] Appl. No.: 668,885

[22] Filed: Nov. 6, 1984

Related U.S. Application Data

[63] Continuation of Ser. No. 485,028, Apr. 14, 1983, abandoned, which is a continuation-in-part of Ser. No. 451,438, Dec. 20, 1982, Pat. No. 4,509,924.

[51] Int. Cl.[4] ..... B63H 25/22

[52] U.S. Cl. ..... 114/150; 440/61

[58] Field of Search ..... 440/51, 53, 55, 61, 440/62, 63, 65, 66; 114/144 R, 150, 146, 162, 167; 244/78, 226; 74/480 R, 480 B; 91/59, 509, 510; 92/134

[56] References Cited

U.S. PATENT DOCUMENTS

| | | | |
|---|---|---|---|
| 2,794,609 | 6/1957 | Perry | 244/226 |
| 3,943,878 | 3/1976 | Kirkwood | 114/144 R |
| 4,054,102 | 10/1977 | Borst et al. | 114/144 R |
| 4,342,275 | 8/1982 | Brix | 114/150 |
| 4,349,341 | 9/1982 | Morgan et al. | 440/51 |

*Primary Examiner*—Trygve M. Blix
*Assistant Examiner*—Jesûs D. Sotelo
*Attorney, Agent, or Firm*—Michael, Best & Friedrich

[57] ABSTRACT

A marine propulsion device comprising a propulsion unit pivotable about a first steering axis to steer a marine vehicle, a trim tab mounted on the propulsion unit and pivotable about a second steering axis for assisting in steering the vehicle, and a hydraulic sensing arrangement for sensing torque on the propulsion unit relative to the first steering axis to pivot the trim tab in response to the torque. The device also includes steering mechanism for pivoting the propulsion unit about the first steering axis to steer the vehicle. The steering mechanism includes a steering member connected to the propulsion unit, and operable to move the steering member to pivot the propulsion unit. The steering mechanism operable to move the steering member includes a push-pull cable with a core and a flexible housing. The hydraulic sensing arrangement permits lost motion between the flexible housing and the steering member and the hydraulic sensing arrangement senses torque on the propulsion unit relative to the first steering axis by movement of the flexible housing relative to the steering member.

38 Claims, 7 Drawing Figures

MARINE PROPULSION STEERING ASSIST DEVICE

RELATED APPLICATION

This is a continuation of application Ser. No. 485,028, filed Apr, 14, 1983, now abandoned, which is a continuation-in-part of Ser. No. 451,438, filed Dec. 20, 1982, now U.S. Pat. No. 4,509,924.

BACKGROUND OF THE INVENTION

This invention relates to marine propulsion devices and, more particularly, to means for linking a movable trim tab or skeg foil to a propulsion unit of a marine propulsion device so that the trim tab or skeg foil responds to torque felt by the propulsion unit.

Attention is directed to McGowan U.S. Pat. No. 4,352,666 issued Oct. 5, 1982 which discloses means for linking the movement of a movable trim tab to the torque on a propulsion unit. The McGowan Patent is directed to mechanical means responsive to the movement of a swivel bracket relative to a transom bracket, as opposed to hydraulic means for sensing torque on the propulsion unit.

Attention is also directed to Kirkwood U.S. Pat. No. 4,323,353, Kirkwood et al U.S. Pat. Nos. 3,943,878 and 4,318,701, Morgan et al U.S. Pat. No. 4,349,341 and Ginnow U.S. Pat. No. 4,362,515 which disclose steering devices including mechanical mechanisms which rotate a trim tab.

SUMMARY OF THE INVENTION

The invention provides a marine propulsion device comprising a propulsion unit pivotable about a first steering axis to steer a marine vehicle, fin means mounted on the propulsion unit and pivotable about a second steering axis for assisting in steering the vehicle, and hydraulic sensing means for sensing torque on the propulsion unit relative to the first steering axis so as to facilitate pivoting of the fin means in response to the torque. The hydraulic sensing means is responsive to hydrodynamic torque on the propulsion unit relative to the first steering axis and steering torque on the propulsion unit relative to the first steering axis caused by the steering means.

The device also includes steering means for pivoting the propulsion unit about the first steering axis to steer the vehicle. The steering means includes a steering member connected to the propulsion unit, and means for moving the steering member to pivot the propulsion unit. The means for moving the steering member includes a push-pull cable with a core and a flexible housing. The hydraulic sensing means permits lost motion between the flexible housing and the steering member and the hydraulic sensing means senses torque on the propulsion unit relative to the first steering axis by movement of the flexible housing relative to the steering member.

In one embodiment, the device further includes means for pivoting the fin means about the second steering axis and means for operably connecting the hydraulic sensing means to the means for pivoting the fin means.

In one embodiment, the marine propulsion device further includes a propeller and means for reversing the direction of movement of the fin means by the pivoting means. The reversing means can operate in response to changes in propeller wash pressure, or the reversing means can operate in response to operation of shifting means for changing the rotation of the propeller.

In one embodiment, the shifting means includes a solenoid actuated when the rotation of the propeller is changed.

In one embodiment, the reversing means comprises valve means and means for operating the valve means. The valve means comprises a valve housing including an elongated cylindrical chamber, a first inlet port, a second inlet port spaced apart from the first inlet port, a first outlet port spaced outside of the first and second inlet ports and adjacent the first inlet port, a second outlet port spaced outside of the first and second inlet ports and adjacent the second inlet port, and a third outlet port spaced between the first and second inlet ports.

The valve means also includes means defining two movable smaller chambers in the elongated cylindrical chamber and comprising three aligned, spaced apart solid cylindrical portions, a first smaller diameter connecting rod connecting the first portion to the second portion, and a second smaller diameter connecting rod connecting the second portion to the third portion.

The means defining the two movable smaller chambers is movable between a first position wherein the first inlet port is in communication with the third outlet port and the second inlet port is in communication with the second outlet port, and a second position wherein the first inlet port is in communication with the first outlet port and the second inlet port is in communication with the third outlet port.

Figure 2:
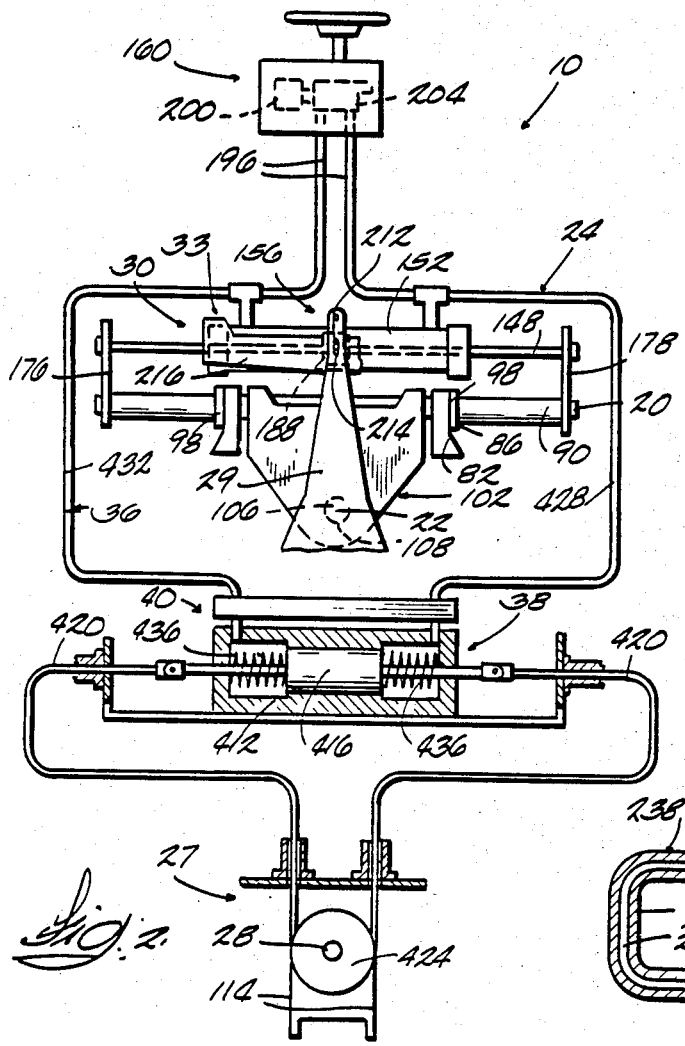
FIG. 2 is a schematic representation of a first embodiment of a marine propulsion device including various features of the invention.

Before explaining at least one embodiment of the invention in detail, it is to be understood that the invention is not limited in this application to the details of construction and the arrangements of components set forth in the following description or illustraed in the drawings. The invention is capable of other embodiments and of being practiced or carried out in various ways. Also, it is to be understood that the phraseology and terminology employed herein is for the purpose of this description and should not be regarded as limiting.

DESCRIPTION OF PREFERRED EMBODIMENTS

As illustrated in the drawings, the invention provides a marine propulsion device 10 including a marine propulsion unit 12 in the form of an outboard motor. In other construction, the propulsion unit 12 can be in the form of a stern drive (not shown). The marine propulsion device 10 also includes means 14 for supporting the propulsion unit from a transom 16 of a marine vehicle 18 for vertical tilting movement of the propulsion unit 12 about a horizontal tilt axis 20 and horizontal steering movement of the propulsion unit 12 about a vertical steering axis 22.

The marine propulsion device 10 also includes three embodiments 24, 25 and 26 (shown respectively in FIGS. 2, 3 and 4) of steering means for pivoting the propulsion unit 12 about the first steering axis 22 to effect steering of the marine vehicle 18 and fin means 27 mounted on the propulsion unit 12 and pivotable about a second vertical steering axis 28 for assisting in steering the marine vehicle 18. The steering means includes a steering member or arm 29 and three embodiments 30, 31, and 32 (shown respectively in FIGS. 2, 3 and 4) of means for moving the steering arm 29 to pivot the propulsion unit 12 to effect steering of the marine vehicle 18.

The marine propulsion device 10 also includes three embodiments 33, 34, and 35 (shown respectively in FIGS. 2, 3 and 4) of hydraulic sensing means for sensing torque on the propulsion unit 12 relative to the first steering axis 22 to pivot the fin means 27 in response to the torque. The three embodiments of the hydraulic sensing means are described in conjunction with the three arrangements of the steering means.

The marine propulsion device 10 also includes means 36 for operably connecting the hydraulic sensing means to means 38 for pivoting the fin means 27 and means 40 for reversing the direction of movement of the fin means 27 in response to operation by the hydraulic sensing means.

Figure 1:
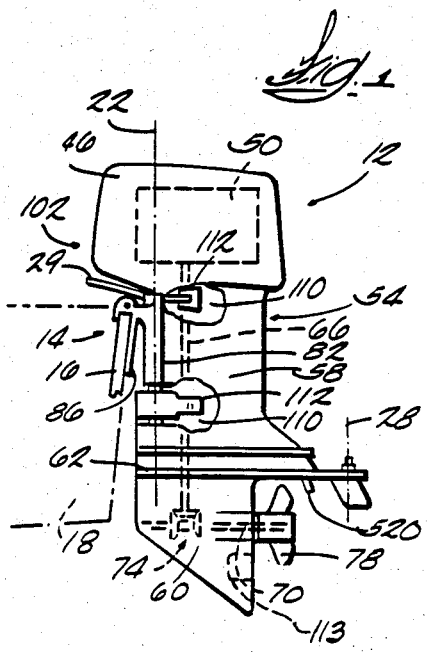
FIG. 1 is a side view of a marine propulsion device including a marine propulsion unit.

More particularly, the propulsion unit 12 shown in FIG. 1 includes a power head 46 including an internal combustion engine 50 which is carried on a lower unit 54 having a drive shaft housing 58 rigidly supporting the internal combustion engine 50 and a gear case 60 rigidly attached to the bottom of the drive shaft housing 58. The lower unit 54 of the propulsion unit 12 also includes an anti-ventilation plate 62 located approximately at the connection of the drive shaft housing 58 to the gear case 60.

Rotatably supported in the drive shaft housing 58 is a vertically disposed drive shaft 66 which is drivenly connected to the engine 50 and also drivingly connected to a propeller shaft 70 through a reversing transmission 74 to drive a propeller 78 carried on the aft end of the propeller shaft 70.

While various arrangements can be employed for the means 14 for supporting the propulsion unit 12 from the transom 16, in the illustrated construction, such means 14 comprises a swivel bracket 82 pivotally connected to a transom bracket 86 adapted to be fixed to the transom 16 of the marine vehicle 18. Vertical tilting of the swivel bracket 82 relative to the transom bracket 86 about the transverse or horizontal tilt axis 20 is provided by a tilt tube 90 including opposite ends extending through aligned apertures 98 in the transom bracket 86 and swivel bracket 82, as illustrated in FIG. 2.

Pivotal movement of the propulsion unit 12 relative to the transom bracket 86 and swivel bracket 82 about the first steering axis 22 is provided by means 102 for pivotally connecting the propulsion unit 12 to the swivel bracket 82. This means 102 includes a kingpin 106 which extends through a vertical bore 108 in the swivel bracket 82. The upper and lower ends of the king pin include means 110 for mounting the propulsion unit 12 on the kingpin 106 in the form, in part, of brackets 112. A more detailed description of one such means 110 for mounting the propulsion unit 12 on the kingpin 106 is described in Hall U.S. Pat. No. 3,934,537, which is incorporated herein by reference.

The fin means 27 is carried by the anti-ventilation plate 62 and is movable between a normal running or neutral steering position and maximum counterbalancing positions clockwise and counterclockwise from the neutral steering position. The fin means 27 is offset toward the rear of the propulsion unit 12 a greater distance from the center of lateral resistance of the gear case 60 than the first steering axis 22. Thus less force is required to pivot the propulsion unit 12 with the fin means 27 than is necessary to pivot the propulsion unit 12 through the steering means. Accordingly, the fin means 27 greatly assists in steering the marine vehicle 18.

Figure 6:
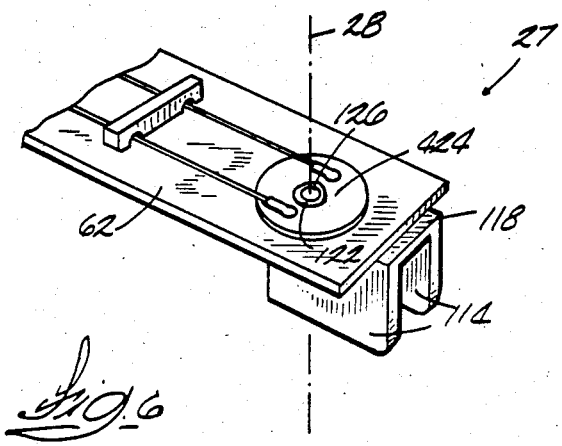
FIG. 6 is a perspective view of a portion of the propulsion device including a trim tab.

In the embodiment illustrated, the fin means 27 comprises a trim tab, although a skeg foil 113 or other steering assisting or torque correcting device can be used in other embodiments. The trim tab 27, in the construction more particularly illustrated in FIG. 6, includes two trim tab elements or fins 114 which can be of any suitable shape and which, at their upper ends, extend fixedly from a common horizontally extending member 118. If desired, the trim tab 27 can employ only a single trim tab element or fin or more than two trim tab elements. Extending upwardly from a forward section of the horizontal member 118, and through a bearing or bushing 122 carried by the anti-ventilation plate 62, as best shown in FIG. 6, is a stud 126 which provides for pivotal movement of the trim tab 27 about the generally vertical second steering axis 28. Any suitable means can be employed to retain the stud 126 in the bearing 122 carried by the anti-ventilation plate 62.

One embodiment 33 of the hydraulic sensing means for sensing torque on the propulsion unit 12 relative to the first steering axis 22, and the first steering means 24 for pivoting the propulsion unit 12 about the first steering axis 22 to steer the vehicle 18 is illustrated in FIG. 2. The first steering means is also disclosed in Hall et al U.S. Pat. No. 4,373,920 issued Feb. 15, 1983 which is incorporated herein by reference.

The steering means 24 includes the steering arm 29 which extends rigidly from the top of the kingpin 106 in a forward direction and means 30 for moving the steering arm 29 to effect pivoting of the propulsion unit 12 to steer the vehicle 18. The moving means 30 comprises elongated support means 148, a member 152 movable on the support means 148, and means 156 for connecting the steering arm 29 to the member 152 movable on the support means 148. Operator activating means 160 is also provided for selectively displacing the member 152 in the direction of the length of the support means 148.

More particularly, the elongated support means 148 is fixed against axial movement relative to the transom bracket 86 and is tiltable relative to the transom bracket 86 to provide common tilting with the swivel bracket 82. The support means 148 also extends in parallel, preferably forward relationship to the tilt axis 20 and comprises an elongated support rod which, at its opposite ends, is fixedly supported by arms 176 and 178 which extend rigidly and radially from opposite ends of the tilt tube 90. The tilt tube 90 is suitably fixed against axial movement relative to the swivel bracket 82 and is rotatable relative to the transom bracket 86 so as to permit tilting in common with the swivel bracket 82.

In the illustrated construction, the member 152 movable along the support rod 148 comprises a hydraulic cylinder, and the hydraulic cylinder 152 and a piston 188 comprise the hydraulic sensing means 33. The support rod 148 is provided with the piston 188 which is fixed centrally thereof and which is received in the hydraulic cylinder 152 which includes opposite ends from which the ends of the support rod 148 extend. The hydraulic cylinder 152 is movable relative to the piston 188 and to the support rod 148 in response to selective application thereto of hydraulic fluid from the operator actuating means 160 through hydraulic conduits 196 connected to the cylinder 152 adjacent the opposite ends thereof. The operator activating means 160 includes a suitable source of pressure hydraulic fluid 200 and a suitable valving arrangement 204 for selectively applying hydraulic fluid pressure to one cylinder end and draining hydraulic fluid from the other cylinder end. As is apparent, the pressure fluid source 200 and the valving arrangement 204 can be located remotely from the propulsion unit 12, as illustrated in FIG. 2.

Means 156 provided for connecting the steering arm 29 to the hydraulic cylinder 152 comprises a stud 212 extending fixedly from the steering arm 29 and received in a slot 214 which is provided in a bracket 216 attached to the hydraulic cylinder 152. The stud 212 extends perpendicularly to the direction of travel of the hydraulic cylinder 152, i.e., perpendicular to the tilt axis 20, and any suitable means can be employed to prevent removal or disconnection of the stud 212 from the slot 214.

The first embodiment 33 of the hydraulic sensing means, as do the other embodiments 34 and 35 of the hydraulic sensing means, operates in response to steering torque initiated by a marine vehicle operator through the operator actuating means 160 and hydrodynamic torque on the propulsion unit 12 caused by forces exterior to the propulsion device 10. The hydrodynamic torques result from lateral thrust on the propulsion unit 12 caused by movement of the propulsion unit 12 through water at an angle and propeller side loads resulting from variations in water density, water surface turbulence and propeller shaft running at an angle to direction of motion.

The operator of the marine vehicle can steer the vehicle by the operator actuating means 160. The operator actuating means 160 adds hydraulic fluid to one end of the hydraulic cylinder 152 and drains hydraulic fluid from the other end of the hydraulic cylinder 152. The resultant fluid pressure differential serves to move the hydraulic cylinder 152 relative to the support rod 148 and pivot the propulsion unit 12. The pressure differential also operates through the means 36 for operably connecting the hydraulic sensing means 33 to the means 38 for pivoting the trim tab 27 to transmit some of the fluid from the operator actuating means 160 to the means 38 for pivoting the trim tab so that the trim tab 27 is pivoted to assist in steering the vehicle 18.

Hydrodynamic loads on the propulsion unit 12 pivot the propulsion unit 12 and, consequently, the steering arm 29 fixed to the propulsion unit 12 moves the hydraulic cylinder 152 relative to the support rod 148 and displaces fluid to adjust the trim tab 27. As the propulsion unit 12 then returns to the position assumed prior to being displaced by the hydrodynamic loads, the hydraulic cylinder 152 returns to its prior position and the trim tab 27 returns to its position prior to the hydrodynamic loads.

Figure 3:
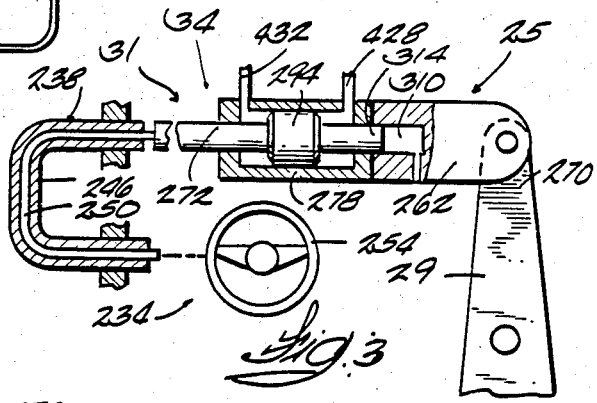
FIG. 3 is a schematic representation of a second embodiment of a marine propulsion device including various features of the invention.

The second embodiment 34 of the hydraulic sensing means for sensing torque on the propulsion unit 12 relative to the first steering axis 22 is illustrated in FIG. 3, in conjunction with the second arrangement 25 for the steering means. In this embodiment, the steering means 25 includes the steering arm 29 and means 31 for moving the steering arm 29 to pivot the propulsion unit 12.

The moving means 31 is operably connected to operator actuating means 234. The operator actuating means 234 comprises a push-pull cable 238 including a flexible housing 246 and a core 250 movable axially by a steering wheel 254 or some other means for moving the flexible core 250. The flexible housing 246 is fixedly mounted to prevent lateral movement of the housing 246.

The means 31 for moving the steering arm 29 is connected between the core 250 and the steering arm 29 and causes movement of the steering arm 29. More particularly, the means 31 for moving the steering arm 29 comprises a receiving member 262 pivotally connected to the end 270 of the steering arm 29, a link arm 272 connected to the core 250 of the push-pull cable 238, and means 34 connecting the core 250 to the receiving member 262 and permitting limited lost motion of the link arm 272 relative to the receiving member 262. The means 34 permitting limited lost motion of the link arm 272 relative to the receiving member 262 is also the hydraulic sensing means 34 in this embodiment.

The hydraulic sensing means 34 comprises a hydraulic cylinder 278 which is incorporated in an end of the receiving member 262 opposite the end thereof pivotally connected to the end 270 of the steering arm 29. Slidably received in the cylinder 278 is a piston 294 fixed on the link arm 272. A vented bore 310 in the receiving member 262 is also provided adjacent the end of hydraulic cylinder 278 adjacent the steering arm 34 to receive the free end 314 of the link arm 272 when the piston 294 moves relative to the receiving member 262.

The hydraulic sensing means 34 is responsive to steering torque on the propulsion unit 12 and operates in the following manner. As the link arm 272 is moved by the core 250 of the push-pull cable 238, the link arm 272 and the piston 294 move relative to the receiving member 262 and the steering arm 29. This relative movement results in the displacement of hydraulic fluid in the hydraulic cylinder 278 which is then used to rotate the trim tab 27. After the piston 294 abuts the hydraulic cylinder 278, the link arm 272 moves the receiving member 262 and the steering arm 29 in order to pivot the propulsion unit 12.

The hydraulic sensing means 34 is also responsive to hydrodynamic torque on the propulsion unit 12 and operates in the following manner. When the steering arm 29 is rotated by torque on the propulsion unit 12 exterior to the propulsion device 10, and the link arm 272 and piston 294 are stationary, hydraulic fluid is displaced by the piston 294 moving relative to the hydraulic cylinder 278 and the displaced fluid causes the trim tab 27 to be adjusted to counteract the torque on the propulsion unit 12.

Figure 4:
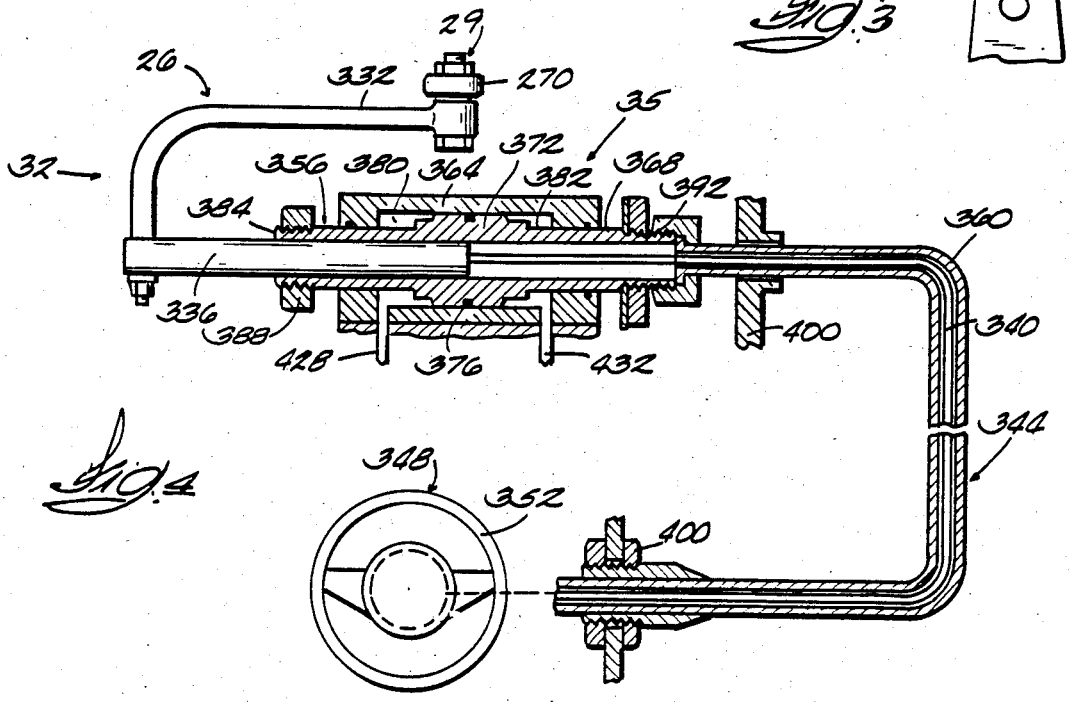
FIG. 4 is a schematic representation of a third embodiment of a marine propulsion device including various features of the invention.

The third embodiment 35 of hydraulic sensing means for sensing torque on the propulsion unit 12 relative to the first steering axis 22 is illustrated in FIG. 4 in conjunction with the third arrangement 26 of the steering means. In this embodiment, the steering means 26 includes the steering arm 29 and means 32 for moving the steering arm 29 to pivot the propulsion unit 12. The moving means 32 includes a connecting arm 332 pivotally connected to the end 270 of the steering arm 29 and a cable ram 336 fixedly connected to the connecting arm 332. The moving means 32 also includes a core 340 of a push-pull cable 344 which is attached to the cable ram 336. The core 340 is also connected to operator activating means 348 including a steering wheel 352 or other means for axially moving the core 340.

The hydraulic sensing means 35 comprises a piston 356, a flexible housing or outer sheath 360 of the push-pull cable 344 connected to the piston 356 and a hydraulic cylinder 364 which slidably receives the piston 356. The hydraulic sensing means 35, in addition to sensing torque on the propulsion unit 12 relative to the first steering axis 22, also permits limited lost motion between the piston 356 and the steering arm 29 and the lost motion is used to adjust the trim tab 27, as hereinafter described.

More particularly, the piston 356 comprises a sleeve 368 which slidably receives the end of cable ram 336 connected to the core 340, and means 372 for separating the two ends 380 and 382 of the hydraulic cylinder 364. In this embodiment, this means 372 comprises a flange 372 extending radially outwardly from the sleeve 368. The flange 372 includes sealing means 376 to prevent fluid communication between the ends 380 and 382 of the hydraulic cylinder 364. One end 384 of the sleeve 368 extends from the end 380 of the hydraulic cylinder 364 and includes stopping means 388 for limiting the amount of movement of the piston 356 relative to the hydraulic cylinder 364, and the other end 392 of the sleeve 268 extends from the opposite end 382 of the cylinder 364 and is fixedly connected to the flexible housing 360, and likewise includes stopping means for limiting the amount of movement of the piston 356 relative to the hydraulic cylinder 364.

The hydraulic sensing means 35 further includes mounting means 400 for securing the push-pull cable housing 360 so that the push-pull cable housing 360 is fixed near the operator actuating means 348 and is slidable near the hydraulic cylinder 364 so an arc formed by the push-pull cable 344 between the mounting means 400 can be varied.

When the core 340 of the cable 344 is pushed by the operator actuating means 348 towards the cable ram 336, the mounting means 400 for securing the cable housing 360 permits the arc of the cable housing 360 to flatten, thereby causing movement of the cable housing 360 and piston 356 relative to the hydraulic cylinder 364. This movement of the piston 356 causes displacement of hydraulic fluid to pivot the trim tab 27 as the cable core 340 moves the cable ram 336 to pivot the propulsion unit 12. In addition, hydrodynamic torque on the propulsion unit 12 pivots the steering arm 29 to cause the cable ram 336 and cable 344 to move relative to the hydraulic cylinder 364. This displaces the piston 356 and results in displacement of hydraulic fluid to also cause adjustment of the trim tab 27.

The means 38 for pivoting the trim tab 27 comprises a hydraulic cylinder 412 and a double ended piston rod 416. As shown in FIG. 6, the ends of the piston rod 416 are each respectively connected to push-pull cables 420 which, in turn, are respectively connected to opposite sides of a disc 424 extending radially outwardly from the upper end of the stud 126. Movement of the piston rod 416 occurs in response to hydraulic fluid displaced from the hydraulic sensing means 33, 34 or 35 and the movement of the piston rod 416 causes a push-pull type operation through the push-pull cables 420 on the disc 424 to rotate the horizontal member 118 to adjust the trim tab 27.

The hydraulic cylinders 152, 278 and 364 of all embodiments 33, 34 and 35 of the hydraulic sensing means are operably connected by the conduit means 36 to the means 38 for pivoting the trim tab 27, as illustrated, for example, in FIG. 2. The conduit means 36 connects the hydraulic cylinder 152, 278 or 364 of the hydraulic sensing means and the hydraulic cylinder 412 of the trim tab pivoting means 38 so that the trim tab 27 serves to counteract torque on the propulsion unit 12 or assist in steering the marine vehicle 18.

More particularly, the conduit means 36 is connected between the cylinder 152, 278 or 364 and the cylinder 412 so that pivoting of the propulsion unit 12 by hydrodynamic loads on the unit 12 results in pivoting of the trim tab 27 in the same direction as the direction of pivoting of the propulsion unit 12. Accordingly, the trim tab 27 counteracts the hydrodynamic torque on the propulsion unit 12 and returns the propulsion unit 12 to the position of the propulsion unit 12 prior to being acted upon by the loads.

Likewise, when operator induced steering torques occur on the propulsion unit 12 through the steering means 24, 25 or 26 and in response to movement by the operator actuating means 160, 234 or 348, the conduit means 36 serves to pivot the trim tab 27 in the opposite direction as the pivoting of the propulsion unit 12.

More particularly, the conduit means 36 includes a first conduit 428 connecting one end of the hydraulic sensing cylinder 152, 278 or 364 to one end of the trim tab adjusting hydraulic cylinder 412 and a second conduit 432 which connects the other end of the hydraulic sensing cylinder 152, 278 or 364 to the other end of the trim tab adjusting hydraulic cylinder 412. The appropriate connections of the conduits 428 and 432 to the appropriate ends of the hydraulic sensing cylinders 152, 278 and 364 is shown in FIGS. 2, 3 and 4.

The parameters affecting the torque correcting or steering assisting capability of the trim tab 27 include the hydraulic cylinder area, the length of the steering arm or other members in the steering means, the trim tab adjusting cylinder area, the distance from the center of the surface area of the trim tabs to the pivot point of the trim tab, the trim tab to unit steering center distance, and the trim tab or foil area. These parameters should be selected so that the counterbalancing torque of the trim tab 27 is less than the initializing torque so that the steering means 24, 25 or 26 has an understeering tendency during forward travel of the marine vehicle.

Alignment of the propulsion unit 12 with the direction of travel of the marine vehicle 18 causes the trim tab 27 to return to the neutral steering position by virtue of the hydraulic sensing and trim tab adjusting means previously described, as well as by having the fins 114 of the trim tab 27 offset rearwardly from the point of pivotal connection of the trim tab 27 to the anti-ventilation plate 62, as shown in FIG. 6.

Additional means 436, however, are provided for biasing the trim tab 27 towards the neutral steering position. Although various means can be employed, in the illustrated construction such means 436 comprises springs disposed in the trim tab adjusting cylinder 412 to bias the piston rod 416 toward a position near the center of the hydraulic cylinder 412 where the trim tab 27 will assume the neutral steering position.

Figure 5:
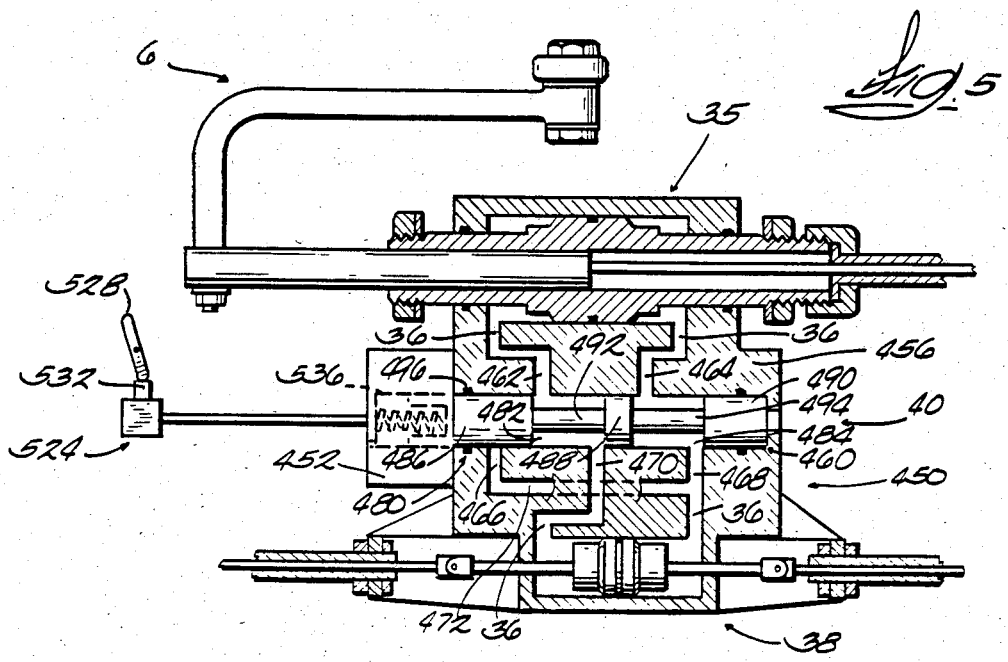
FIG. 5 is a view partially in section of the third embodiment of the marine propulsion device and reversing means including various features of the invention.

As shown in FIG. 5, spliced in the conduit means 36 connecting the hydraulic sensing means 33, 34 or 35 and the means 38 for pivoting the trim tab 27 is the means 40 for reversing the direction of movement of the trim tab 27 in response to operation by the hydraulic sensing means 33, 34 or 35. The reversing means 40 comprises valve means 450 and means 452 for operating the valve means 450 in response to changes in propeller wash pressure or changes in the direction of rotation of the propeller 78.

The valve means 450 comprises a valve housing 456 including an elongated cylindrical chamber 460 and first and second spaced-apart inlet ports 462 and 464 on one side of the chamber 460 and in communication with the hydraulic sensing means 33, 34 or 35. The valve housing 456 also includes three spaced-apart chamber outlet ports 466, 468 and 470 on an opposite side of the chamber 460. The first and second chamber outlet ports 466 and 468 are spaced opposite one another outside of the inlet ports 462 and 464, and the third chamber outlet port 470 is spaced between the inlet ports 462 and 464. The second chamber outlet port 468 is in communication with one side of the trim tab adjusting hydraulic cylinder 412 and in communication with the first chamber outlet port 466 by means of a bore 472 in the housing 456 running parallel to the chamber 460. The third chamber outlet port 470 is in communication with the other side of the trim tab adjusting hydraulic cylinder 412.

The valve means 450 further includes means 480 defining two movable smaller chambers 482 and 484 in the housing chamber 460, and which, in the illustrated construction, comprises a valve member. The valve member 480 includes three spaced apart coaxial solid cylindrical portions 486, 488 and 490 connected to one another by two smaller diameter connecting rods 492 and 494. The valve member 480 is snugly received in the housing chamber 460 and the three spaced-apart cylindrical portions 486, 488 and 490 serve to divide the housing chamber 400 into the two movable smaller chambers 482 and 484, with the intermediate solid cylindrical portion 488 dividing the two chambers 482 and 484. The two outer cylindrical portions 486 and 490 include sealing means 496 for effectively sealing the smaller chambers 482 and 484 from the remainder of the housing chamber 460. The housing chamber 460 is vented at both ends to permit movement of the valve member 480.

The valve member 480 is movable between two positions by the means 452 for operating the valve means. In the first position, the valve member 480 is to the right side of the housing chamber 460, as shown in FIG. 5, and the movable smaller chambers 482 and 484 permit fluid to pass from the inlet ports 462 and 464 to the third and second chamber outlet ports 470 and 468, respectively. In addition, the left cylindrical portion 486 closes the first outlet port 466 and the intermediate cylindrical portion 488 separates the second inlet port 464 from the third outlet port 470.

In the second position, the valve member 480 is to the left side of the housing chamber 460, as shown in FIG. 5, and the movable smaller chambers 482 and 484 permit fluid to pass from the inlet ports 462 and 464 to the first chamber outlet port 466 and the third chamber outlet port 470, respectively. More particularly, the right cylindrical portion 490 closes the second outlet portion 468 and the intermediate cylindrical portion 488 separates the first inlet port 462 from the third chamber outlet port 470. The valve member 480 thus serves to reverse the fluid connection between the hydraulic sensing means and the means 38 for pivoting the trim tab 28.

As illustrated in FIG. 5, the valve housing 456 also includes the hydraulic sensing means 320 and the means 38 for pivoting the trim tab 27, although in other arrangements, the hydraulic sensing means 33, 34 or 35 and means 38 for pivoting the trim tab 27 can be enclosed in separate housings and connected to the valve housing 456 by the conduit means 36, as illustrated for example, schematically in FIG. 2.

Various arrangements can be employed for the means 452 for operating the valve means 450 in response to changes in propeller wash pressure or changes in the direction of the rotating propeller 78.

One such arrangement includes, as illustrated in FIG. 1, a pitot tube 520 disposed in the propeller wash behind the propeller 78. The pitot tube 520 is operably connected to one end of the valve member 480 by means (not shown) to move the valve member 480 from one position to another in response to changes in propeller wash pressure.

In another arrangement, the valve member 480 is operably connected to means 524 for shifting the direction of the rotation of the propeller 78. Although various means of providing such an operable connection are possible, one constuction could include mechanical linkage (not shown) to move the valve member 480 from the one position to another as the shifting means 524 is moved from a forward to reverse position, for example.

In a third arrangement, the shifting means 524 includes a shift lever 528 which is operably connected to an electrical switch 532. The electrical switch 532 is operably connected to a solenoid 536 attached to one end of the movable valve member 480. As the shift lever 528 is moved from a forward to reverse position, for example, the switch 532 closes and activates the solenoid 536 in order to move the valve member 480 from one position to another. And in a fourth arrangement, an electrical switch (not shown) can be provided between the brackets 112 of the means 110 for mounting the propulsion unit 12 on the king pin 106 and the drive shaft housing 58 to detect movement of the propulsion unit 12 relative to the brackets 112 when the marine vehicle 18 changes direction.

Figure 7:
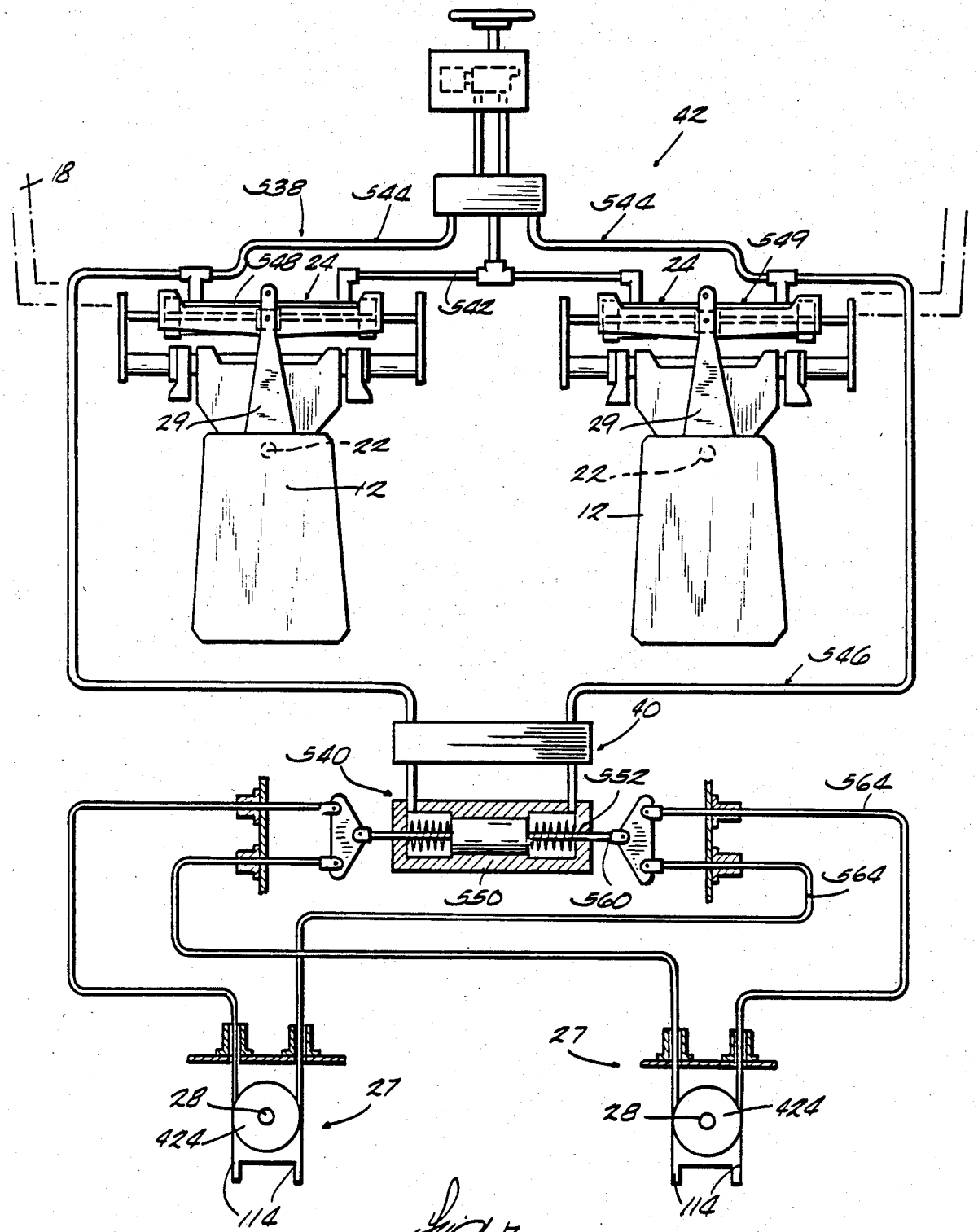
FIG. 7 is a schematic view of another embodiment of a marine propulsion device including various features of the invention.

In another embodiment of the invention, as illustrated in FIG. 7, a marine propulson device 42 includes a plurality of propulsion units 12. Each propulsion unit 12 has associated means 14 for supporting the propulsion unit from the transom 16 of the marine vehicle 18, hydraulic sensing means 33, steering means 24 for pivoting the propulsion unit 12 about parallel first steering axes 22, and fin means 27, all as previously described. The first embodiments of the hydraulic sensing means 33 and steering means 24 are disclosed and illustrated in FIG. 7, although the other embodiments 34, 35 and 25, 26, respectively, can be used.

The marine propulsion device 42 also includes means 538 for connecting the hydraulic sensing means 33 to trim tab pivoting means 540. The connecting means 538 include conduits 542 which connect hydraulic cylinders 548 and 549 of the hydraulic sensing means 33 in series and conduits 544 which connect the cylinders 548 and 549 to the operator actuating means 184. A more particularized description of the propulsion unit connection arrangement is contained in a copending application filed by Charles B. Hall as Ser. No. 258,874 on Apr. 29, 1981 and which is incorporated herein by reference.

The connecting means 538 also includes conduit means 546 which connects the first hydraulic cylinder 548 and the last hydraulic cylinder 549 to the means for pivoting the trim tabs 27, as illustrated in FIG. 7.

In this embodiment, the means 540 for pivoting the trim tabs 27 in response to operation by the hydraulic sensing means 33 comprises a hydraulic cylinder 550 and a double-ended piston rod 552. Each end 560 of the piston rod 552 is connected to a plurality of push-pull cables 564 which in turn are connected to a similar side of each of the trim tab discs 424. Movement of the piston rod 552 causes a push-pull type operation through the push-pull cables 564 to cause similar adjustment of each of the trim tabs 27.

Spliced in the conduit means 546 connecting the trim tab adjusting cylinder 550 to the first and last hydraulic cylinders 548 and 549 is the means 40 for reversing the direction of movement of the trim tabs 27 in response to operation by the hydraulic sensing means 33.

Various of the features of the invention are set forth in the following claims.

We claim:

1. A marine propulsion device for use with a marine vehicle, said device comprising a propulsion unit pivotable about a first steering axis to steer the vehicle, fin means mounted on said propulsion unit and pivotable about a second steering axis for assisting in steering the vehicle, steering means for pivoting said propulsion unit about said first steering axis to steer the vehicle, said steering means including a steering member connected to said propulsion unit, and means for moving said steering member to pivot said propulsion unit, said moving means including a push-pull cable including a flexible housing, and hydraulic sensing means for sensing torque on said propulsion unit relative to said first steering axis so as to facilitate pivoting of said fin means in response to said torque, said hydraulic sensing means permitting lost motion between said flexible housing and said steering member, and said hydraulic sensing means sensing torque on the propulsion unit relative to the first steering axis by movement of said flexible housing relative to said steering member.

2. A marine propulsion device in accordance with claim 1 wherein said hydraulic sensing means comprises a hydraulic cylinder housing and a piston received in said hydraulic cylinder housing, and wherein said flexible housing is attached to said piston.

3. A marine propulsion device in accordance with claim 2 wherein said piston has a central bore, and wherein said push-pull cable further includes a core extending into said central bore, and wherein said means for moving said steering member further includes a connecting arm pivotally connected to said steering arm, and a cable ram connected between said connecting arm and said core and slidable in said central bore.

4. A marine propulsion device in accordance with claim 1 wherein said second steering axis is parallel to said first steering axis.

5. A marine propulsion device in accordance with claim 1 wherein said fin means comprises a trim tab.

6. A marine propulsion device in accordance with claim 1 wherein said fin means comprises a skeg foil.

7. A marine propulsion device in accordance with claim 1 and further including means for pivoting said fin means and means for operably connecting said hydraulic sensing means to said means for pivoting said fin means.

8. A marine propulsion device in accordance with claim 7 wherein said fin pivoting means includes biasing means for biasing said fin means towards a neutral steering position.

9. A marine propulsion device in accordance with claim 8 wherein said fin pivoting means includes a piston rod in a hydraulic cylinder, and wherein said biasing means includes springs in said cylinder, said springs biasing said piston rod towards a position near the center of said hydraulic cylinder.

10. A marine propulsion device in accordance with claim 7 wherein said connecting means further includes means for reversing the direction of movement of said fin means by said fin pivoting means.

11. A marine propulsion device in accordance with claim 10 wherein said reversing means includes means for sensing propeller wash pressure, and said reversing means operates in response to changes in propeller wash pressure.

12. A marine propulsion device in accordance with claim 10 wherein said propulsion unit includes a rotating propeller and said device further includes shifting means for changing the rotation of said propeller, and said reversing means reverses the pivotal movement of said fin means in response to operation of said shifting means.

13. A marine propulsion device in accordance with claim 12 wherein said shifting means includes a solenoid actuated when the rotation of said propeller is changed and wherein said reversing means is operated by said solenoid.

14. A marine propulsion device in accordance with claim 10 wherein said reversing means comprises valve means and means for operating said valve means.

15. A marine propulsion device in accordance with claim 14 wherein said valve means comprises a valve housing including an elongated cylindrical chamber, a first inlet port, a second inlet port spaced apart from said first inlet port, a first outlet port spaced outside of said first and second inlet ports and adjacent said first inlet port, a second outlet port spaced outside of said first and second inlet ports and adjacent said second inlet port, and a third outlet port spaced between said first and second inlet ports, means defining two movable smaller chambers in said elongated cylindrical chamber and comprising first, second and third aligned, spaced apart solid cylindrical portions, a first smaller diameter connecting rod connecting said first portion to said second- portion, and a second smaller diameter connecting rod connecting said second portion to said third portion, said means defining two movable smaller chambers being movable between a first position wherein said first inlet port is in communication with said third outlet port and said second inlet port is in communication with said second outlet port, and a second position wherein said first inlet port is in communication with said first outlet port and said second inlet port is in communication with said third outlet port.

16. A marine propulsion device for use with a marine vehicle, said device comprising a propulsion unit pivotable about a first steering axis to steer the vehicle, fin means mounted on said propulsion unit and pivotable about a second steering axis for assisting in steering the vehicle, a push-pull cable operably connected to said propulsion unit and including a flexible inner core connected to said propulsion unit for pivoting thereof in response to movement of said inner core and a flexible outer housing containing said inner core, and hydraulic sensing means for sensing torque on said propulsion unit relative to said first steering axis in response to movement of one of said inner core and said outer housing relative to said propulsion unit and including a hydraulic cylinder housing and a piston received in said hydraulic cylinder housing and connected to said flexible housing, and means permitting lost motion between said steering member and said outer housing in response to torque on said propulsion unit relative to the first steering axis.

17. A marine propulsion device in accordance with claim 16 wherein said piston has a central bore, and wherein said push-pull cable further includes a core extending into said central bore, and wherein said means for moving said steering member further includes a connecting arm pivotally connected to said steering arm, and a cable ram: connected between said connecting arm and said core and slidable in said central bore.

18. A marine propulsion device in accordance with claim 16 wherein said second steering axis is parallel to said first steering axis.

19. A marine propulsion device in accordance with claim 16 wherein said fin means comprises a trim tab.

20. A marine propulsion device in accordance with claim 16 wherein said fin means comprises a skeg foil.

21. A marine propulsion device in accordance with claim 16 and further including means for pivoting said fin means and means for operably connecting said hydraulic sensing means to said means for pivoting said fin means.

22. A marin propulsion device in accordance with claim 21 wherein said fin pivoting means includes biasing means for biasing said fin means towards a neutral steering position.

23. A marine propulsion device in accordance with claim 22 wherein said fin pivoting means includes a piston rod in a hydraulic cylinder, and wherein said biasing means includes springs in said cylinder, said springs biasing said piston rod towards a position near the center of said hydraulic cylinder.

24. A marine propulsion device in accordance with claim 21 wherein said connecting means further includes means for reversing the direction of movement of said fin means by said fin pivoting means.

25. A marine propulsion device in accordance with claim 24 wherein said reversing means includes means for sensing propeller wash pressure, and said reversing means operates in response to changes in propeller wash pressure.

26. A marine propulsion device in accordance with claim 24 wherein said propulsion unit includes a rotating propeller and said device further includes shifting means for changing the rotation of said propeller, and said reversing means reverses the pivotal movement of said fin means in response to operation of said shifting means.

27. A marine propulsion device in accordance with claim 26 wherein said shifting means includes a solenoid actuated when the rotation of said propeller is changed and wherein said reversing means is operated by said solenoid.

28. A marine propulsion device in accordance with claim 24 wherein said reversing means comprises valve means and means for operating said valve means.

29. A marine propulsion device in accordance with claim 28 wherein said valve means comprises a valve housing including an elongated cylindrical chamber, a first inlet port, a second inlet port spaced apart from said first inlet port, a first outlet port spaced outside of said first and second inlet ports and adjacent said first inlet port, a second outlet port spaced outside of said first and second inlet ports and adjacent said second inlet port, and a third outlet port spaced between said first and second inlet ports, means defining two movable smaller chambers in said elongated cylindrical chamber and comprising first, second, and third aligned, spaced apart solid cylindrical portions, a first smaller diameter connecting rod connecting said first portion to said second portion, and a second smaller diameter connecting rod connecting said second portion to said third portion, said means defining two movable smaller chambers being movable between a first position wherein said first inlet port is in communication with said third outlet port and said second inlet port is in communication with said second outlet port, and a second position wherein said first inlet port is in communication with said first outlet port and said second inlet port is in communication with said third outlet port.

30. A marine propulsion device for use with a marine vehicle, said device comprising a propulsion unit pivotable about a first steering axis to steer the vehicle, fin means mounted on said propulsion unit and pivotable about a second steering axis for assisting in steering the vehicle, steering means for applying torque to said propulsion unit to effect steering movement thereof about said first steering axis and including a steering member connected to said propulsion unit, means for moving said steering member to pivot said propulsion unit and including a push-pull cable including an outer housing and an inner core, hydraulic sensing means connected to one of said inner core and said outer housing for sensing torque on said propulsion unit relative to said first steering axis in response to movement of said one of said inner core and said outer housing relative to said propulsion unit, means for permitting lost motion between said steering member and the other of said outer housing and said inner core, and means connecting said hydraulic sensing means to said fin means for effecting fin means movement about said second steering axis in the opposite rotary direction from the steering movement of said propulsion unit and in response to the torque sensed by said sensing means.

31. A marine propulsion device in accordance with claim 30 wherein said hydraulic sensing means comprises a hydraulic cylinder housing and a piston received in said hydraulic cylinder housing.

32. A marine propulsion device in accordance with claim 30 wherein said fin means comprises a skeg foil.

33. A marine propulsion device in accordance with claim 30 and further including means for biasing said fin means toward a neutral steering position.

34. A marine propulsion device in accordance with claim 30 wherein said connecting means further includes means selectively operable for effecting fin means movement in both rotary directions.

35. A marin epropulsion device in accordance with claim 34 wherein said selectively operable means includes means for sensing propeller wash pressure, and said selectively operable means operates in response to changes in propeller wash pressure.

36. A marine propulsion device in accordance with claim 34 wherein said propulsion unit includes a rotating propeller and said device further includes shifting means for changing the direction of rotation of said propeller, and said selectively operable means reverses the direction of the rotary movement of said fin means relative to the direction of rotation of said propulsion unit in response to changing of the direction of propulsion rotation by said shifting means.

37. A marine propulsion device in accordance with claim 34 wherein said selectively operable means comprises valve means, and means for operating said valve means.

38. A marine propulsion device in accordance with claim 37 wherein said valve means comprises a valve housing including an elongated cylindrical chamber, a first inlet port, a second inlet port spaced apart from said first inlet port, a first outlet port spaced outside of said first and second inlet ports and adjacent said first inlet port, a second outlet port spaced outside of said first and second inlet ports and adjacent said second inlet port, and a third outlet port spaced between said first and second inlet ports, means defining two movable smaller chambers in said elongated cylindrical chamber and comprising three aligned, spaced apart solid cylindrical portions, a first smaller diameter connecting rod connecting said first portion to said second portion, and a second smaller diameter connecting rod connecting said second portion to said third portion, said means defining two movable smaller chambers being movable between a first position wherein said first inlet port is in communication with said third outlet port and said second inlet port is in communication with said second outlet port, and a second position wherein said first inlet port is in communication with said first outlet port and said second inlet port is in communication with said third outlet port.

* * * * *